US010155653B2

(12) United States Patent
Tojima et al.

(10) Patent No.: US 10,155,653 B2
(45) Date of Patent: Dec. 18, 2018

(54) AUTOMATIC SUPPLY SYSTEM OF CONSUMABLE MATERIAL

(75) Inventors: Masanori Tojima, Fujisawa (JP); Kouichi Yamashita, Yokohama (JP); Tsugio Sudou, Tokyo (JP); Koji Takeda, Tama (JP)

(73) Assignee: Komatsu Ltd., Tokyo (JP)

( * ) Notice: Subject to any disclaimer, the term of this patent is extended or adjusted under 35 U.S.C. 154(b) by 163 days.

(21) Appl. No.: 14/110,514

(22) PCT Filed: May 9, 2012

(86) PCT No.: PCT/JP2012/061824
§ 371 (c)(1),
(2), (4) Date: Oct. 8, 2013

(87) PCT Pub. No.: WO2012/153753
PCT Pub. Date: Nov. 15, 2012

(65) Prior Publication Data
US 2014/0027013 A1 Jan. 30, 2014

(30) Foreign Application Priority Data
May 10, 2011 (JP) ..... 2011-105746

(51) Int. Cl.
*B67D 7/32* (2010.01)
*B67D 7/34* (2010.01)

(52) U.S. Cl.
CPC ..... *B67D 7/32* (2013.01); *B67D 7/348* (2013.01)

(58) Field of Classification Search
CPC .. B67D 7/32; B67D 7/348; H04N 7/18; B60L 5/045
(Continued)

(56) References Cited

U.S. PATENT DOCUMENTS 2,756,983 A * 7/1956 Furcini ..... G01G 5/04 177/139
4,307,300 A * 12/1981 Kisami ..... 307/9.1
(Continued)

FOREIGN PATENT DOCUMENTS

CN 101096797 A 1/2008
JP 55019690 A * 2/1980
(Continued)

OTHER PUBLICATIONS

International Search Report dated Jul. 24, 2012, issued for PCT/JP2012/061824.
(Continued)

*Primary Examiner* — Jason K Niesz
*Assistant Examiner* — James Hakomaki
(74) *Attorney, Agent, or Firm* — Locke Lord LLP

(57) ABSTRACT

An automatic supply system of a consumable material includes: an automatic supply device that automatically supplies a consumable material to a vehicle capable of being loaded with a cargo; and a control device that obtains loading information indicating whether or not the cargo is loaded on the vehicle, and is able to control an automatic supply of the consumable material to the vehicle based on the obtained loading information, wherein, when the control device determines that the cargo is loaded on the vehicle from the obtained loading information, the control device controls the automatic supply device not to perform the automatic supply of the consumable material to the vehicle.

4 Claims, 4 Drawing Sheets

(58) Field of Classification Search
USPC ..... 141/192, 94, 98; 348/148; 123/198; 180/272; 177/136
See application file for complete search history.

(56) References Cited

U.S. PATENT DOCUMENTS 4,630,227 A * 12/1986 Hagenbuch ..... G01G 19/08 177/136
4,981,186 A * 1/1991 Shankle et al. ..... 177/141
5,327,347 A * 7/1994 Hagenbuch ..... G01G 19/08 701/29.4
5,383,500 A * 1/1995 Dwars et al. ..... 141/98
5,528,499 A * 6/1996 Hagenbuch ..... G01G 19/08 701/29.4
5,822,224 A * 10/1998 Nakanishi et al. ..... 702/174
5,880,408 A * 3/1999 Schreiner ..... G01G 19/08 177/1
6,134,493 A * 10/2000 Kaneko ..... G05D 1/0289 340/988
6,237,647 B1 * 5/2001 Pong ..... B67D 7/0401 141/231
6,321,178 B1 * 11/2001 Sugano et al. ..... 702/182
6,382,269 B1 * 5/2002 Tatsuno ..... B67D 7/0401 141/104
6,858,809 B2 * 2/2005 Bender ..... G01G 19/12 177/136
6,990,945 B1 * 1/2006 Kropinski ..... F02D 41/042 123/198 D
8,589,035 B2 * 11/2013 Adolfson ..... B60K 28/08 701/50
2003/0093203 A1 * 5/2003 Adachi ..... E02F 9/2045 701/50
2003/0150417 A1 * 8/2003 Miwa ..... F02N 11/0833 123/179.4
2007/0291130 A1 * 12/2007 Broggi et al. ..... 348/218.1
2009/0063222 A1 * 3/2009 Doan et al. ..... 705/7
2010/0084908 A1 * 4/2010 Montocchio ..... B60P 1/283 298/22 C
2013/0120579 A1 * 5/2013 Mlitsuta et al. ..... 348/148
2014/0027013 A1 1/2014 Tojima et al.

FOREIGN PATENT DOCUMENTS

JP 63-67296 A 3/1988
JP 04-1048 U 1/1992
JP 04-031297 A 2/1992
JP 04-128187 A 4/1992
JP 05-112396 A 5/1993
JP WO 2010092873 A1 * 8/2010 ..... B60P 1/283

OTHER PUBLICATIONS

Office Action dated Feb. 19, 2016 issued for corresponding Australian Patent Application No. 2015249203.

* cited by examiner

AUTOMATIC SUPPLY SYSTEM OF CONSUMABLE MATERIAL

FIELD

The present invention relates to an automatic supply system of a consumable material, which automatically supplies a consumable material such as fuel and oil to a vehicle.

BACKGROUND

In the past, as the automatic supply system of a consumable material, an automatic refueling system has been known which detects a refueling opening of a vehicle fuel tank provided in the vehicle by a camera, and controls a manipulator for holding a nozzle based on a detected position of the refueling opening, to insert the nozzle into the refueling opening (for example, see Patent Literature 1). In such an automatic refueling system, when the vehicle stops in the vicinity of the automatic refueling system, the automatic refueling is started.

CITATION LIST

Patent Literature

Patent Literature 1: Unexamined Japanese Patent Application Publication No, 05-112396

SUMMARY

Technical Problem

Incidentally, as a vehicle subjected to the automatic refueling, for example, there is a dump truck capable of loading a cargo such as rocks and soils used in a mine. At this time, when the automatic refueling of fuel using the automatic refueling system is performed in a state where the cargo is loaded, there is a concern that the cargo falls at the time of refueling of the fuel. When the cargo falls at the time of refueling of the fuel, there is a concern that the fallen cargo damages the automatic refueling system and supplementary equipment.

Accordingly, an object of the invention is to provide an automatic supply system of a consumable material, which is capable of suppressing the falling of the cargo from the vehicle when the consumable material is automatically supplied.

Solution to Problem

According to the present invention, an automatic supply system of a consumable material comprises: an automatic supply device that automatically supplies a consumable material to a vehicle capable of being loaded with a cargo; and a control device that obtains loading information indicating whether or not the cargo is loaded on the vehicle, and is able to control an automatic supply of the consumable material to the vehicle based on the obtained loading information, wherein, when the control device determines that the cargo is loaded on the vehicle from the obtained loading information, the control device controls the automatic supply device not to perform the automatic supply of the consumable material to the vehicle.

According to the present invention, the automatic supply system of a consumable material further comprises: a cargo detection unit capable of detecting whether or not the cargo is loaded on the vehicle as the loading information, wherein the cargo detection unit comprises at least one of a loadage detecting unit that detects loadage of the cargo loaded on the vehicle, an imaging unit that takes an image of the cargo loaded on the vehicle, and a vehicle weight measuring unit that measures a weight of the vehicle.

According to the present invention, the automatic supply system of a consumable material further comprises: a notifying unit that provides a notification that the cargo is loaded on the vehicle.

According to the present invention, the vehicle comprises a vessel capable of loading the cargo, and the automatic supply device automatically supplies the consumable material to the vehicle in a range on a lower side in the vertical direction of the vessel, the range being an inner side than an edge portion of the vessel, as viewed in a plan view from the vertical direction.

According to the present invention, an automatic supply system of a consumable material comprises: an automatic supply device that automatically supplies a consumable material to a vehicle having a vessel capable of loading a cargo; and a control device capable of controlling the automatic supply device, wherein the automatic supply device automatically supplies the consumable material, to the vehicle in a range on a lower side in the vertical direction of the vessel, the range being an inner side than an edge portion of the vessel as viewed in a plan view from the vertical direction.

According to the automatic supply system of a consumable material of the invention, in a case where the cargo is loaded on the vehicle, since a consumable material such as fuel and oil is not supplied, it is possible to suppress the damage of the device, the equipment and the like due to the fall of the cargo at the time of supplying the consumable material.

DESCRIPTION OF EMBODIMENTS

Hereinbelow, an automatic supply system of a consumable material according to the invention will be described with reference to the accompanying drawings. In addition, it is not intended that the invention be limited by the following examples. In addition, constituent elements in the examples described below include elements that are easily replaceable by those skilled in the art or substantially the same elements.

First Embodiment

The automatic supply system of a consumable material of a first embodiment is applied, to a trolley transport system. The trolley transport system is a system in which an electric power is supplied to the transport vehicle, by bringing a pantograph into contact with a trolley wire supplied with the electric power, and the cargo mounted on the transport vehicle is transported using the supplied electric power as an auxiliary power of the transport vehicle.

<Configuration of Trolley Transport System>

Figure 1:
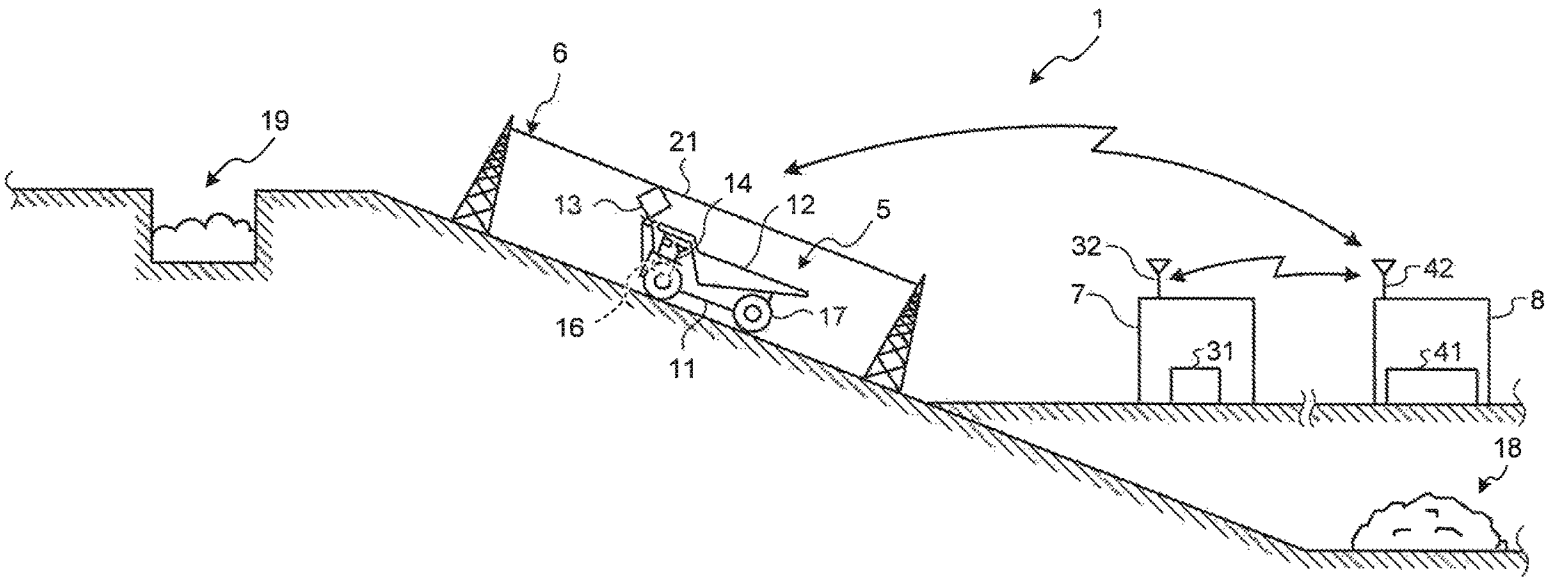
FIG. 1 is a diagram schematically illustrating a configuration of a trolley transport system to which an automatic supply system of a consumable material of a first embodiment is applied.

FIG. 1 is a diagram schematically illustrating a configuration of the trolley transport system to which an automatic supply system of a consumable material of the first embodiment is applied. As illustrated in FIG. 1, a trolley transport system 1 is used in mines and the like, and includes a transport vehicle 5, power feeding equipment 6, refueling equipment 7, and central management control equipment 8 for managing and controlling these constituents.

The transport vehicle 5 is a so-called dump truck with a trolley assist function having a pantograph and can perform unmanned driving. In addition, in the first embodiment, although the transport vehicle 5 capable of performing the unmanned driving is described, the vehicle may also be applied to a transport vehicle capable of performing manned traveling. The transport vehicle 5 has a vehicle main body 11, a vessel 12, a pantograph 13, a communication unit 14, a position detection unit 15, and a control unit 16.

The vehicle main body 11 is a vehicle that generates the power using fuel in an engine and generates the power using the electric power in a motor, and is able to travel by transmitting the generated power to drive wheels 17. The vessel 12 is loaded with the cargo and is disposed above the vehicle main body 11. Waste soils such as rocks and soils are loaded on the vessel 12 as the cargo. In addition, the vessel 12 may have a configuration capable of being attachable and detachable to and from the vehicle main body 11. The pantograph 13 functions as a current collector, is disposed on a front side in an advancing direction of the vehicle main body 11, and is provided so as to be located at the uppermost part of the transport vehicle 5.

The communication unit 14 is connected to the control unit 16 to perform wireless communication between the control unit 16 of the transport vehicle 5 and the central management control equipment 8. The communication unit 14 obtains information transmitted from the central management control equipment 8 and outputs the information toward the control unit 16. Furthermore, the communication unit 14 obtains information that is output from the control unit 16, and transmits the information toward the central control equipment 8. For example, as the position detection unit 15, a global, positioning system (GPS) is used to recognize the position of the transport vehicle 5. The position detection unit 15 is connected to the control unit 16 to output the detected position information to the control unit 16. Moreover, the control unit 16 controls the operation of each unit such as a steering and drive wheels of the transport vehicle 5 or transmits various types of information obtained toward the central management control equipment 8 via the communication unit 14, based on various types of information such as an obtained traveling route and target velocity.

The transport vehicle 5 having such a configuration transports the cargo along a predetermined traveling route, while being controlled by the control unit 15. Specifically, the transport vehicle 5 travels back and forth between a loading yard 18 for loading the cargo and an earth-removing yard 19 (unloading yard) for unloading the cargo. Further, when the fuel is consumed and a residual quantity of the fuel is low, the transport vehicle 5 travels toward the refueling equipment 7, while being controlled by the control unit 15.

The power feeding equipment 6 has a trolley wire 21 to which the electric power is supplied from a power supply (not illustrated). The trolley wire 21 is disposed in a predetermined section of the traveling route through which the transport vehicle 5 travels, and is provided above the transport vehicle 5. For example, the trolley wire 21 is provided on a pitched section as a predetermined section. For this reason, the power feeding equipment 6 supplies the electric power to the transport vehicle 5 via the pantograph 13 coming into contact with the trolley wire 21, as an auxiliary power of the transport vehicle 5 for performing the pitched traveling.

The refueling equipment 7 has a fuel supply device 31, a communication unit 32, and a control unit 33. The fuel supply device 31 supplies the fuel to the transport vehicle 5 entering the refueling equipment 7. The communication unit 32 is connected to the control unit 33, performs the wireless communication between the control unit 33 of the refueling equipment 7 and the central management control equipment 8, and performs the transmission and reception of various types of information. The control unit 33 controls the operation of each part of the fuel supply device 31 or transmits various types of information obtained toward the central management control equipment 8 via the communication unit 32, based on various types of information obtained. In addition, although the details will be described below, the fuel supply device 31 constitutes a part of an automatic supply system 50 and has a configuration capable of automatically supplying the fuel to the transport vehicle 5.

The central management control equipment 8 is provided at a different location from the transport vehicle 5, the power feeding equipment 6, and the refueling equipment 7, and has a management controller 41, and a communication unit 42. The communication unit 42 performs the wireless communication among the transport vehicle 5, the refueling equipment 7, and the management controller 41, and performs the transmission and reception of various types of information. The management controller 41 is operated by an operator, based on various types of information obtained via the communication unit 42. Specifically, the management controller 41 recognizes the position of the transport vehicle 5, manages the operating conditions of the transport vehicle 5, or controls the operation of the transport vehicle 5, based on various types of information transmitted from the transport vehicle 5. Similarly, the management controller 41 manages the operating conditions of the refueling equipment 7 or controls the operation of the refueling equipment 7, based on various types of information transmitted from the refueling equipment 7.

Therefore, in the trolley transport system 1, the operating conditions of the transport vehicle 5 are managed in the central management control equipment 8, and the operation of the transport vehicle 5 is controlled, based on the managed operating conditions of the transport vehicle 5. That is, in the trolley transport system 1, by the transmission of various types of information from the central management control equipment 8 to the control unit 15 of the transport vehicle 5 via the communication unit 42 and the communication unit 14 based on the operating conditions of the transport vehicle 5, the operation of the transport vehicle 5 is controlled. For this reason, when the transport vehicle 5 travels in the pitched section, the transport vehicle 5 is able to travel, in the traveling route between the loading yard 18 and the earth-removing yard 19, while using the electric power supplied from the trolley wire 21 as the auxiliary power, by bringing the pantograph 13 into contact with the trolley wire 21 of the power feeding equipment 6. Furthermore, when the fuel of the transport vehicle 5 is consumed and the residual quantity of the fuel is low, the transport vehicle 5 can travel towards the refueling equipment 7.

<Configuration of Automatic Supply System of Consumable Material>

Figure 2:
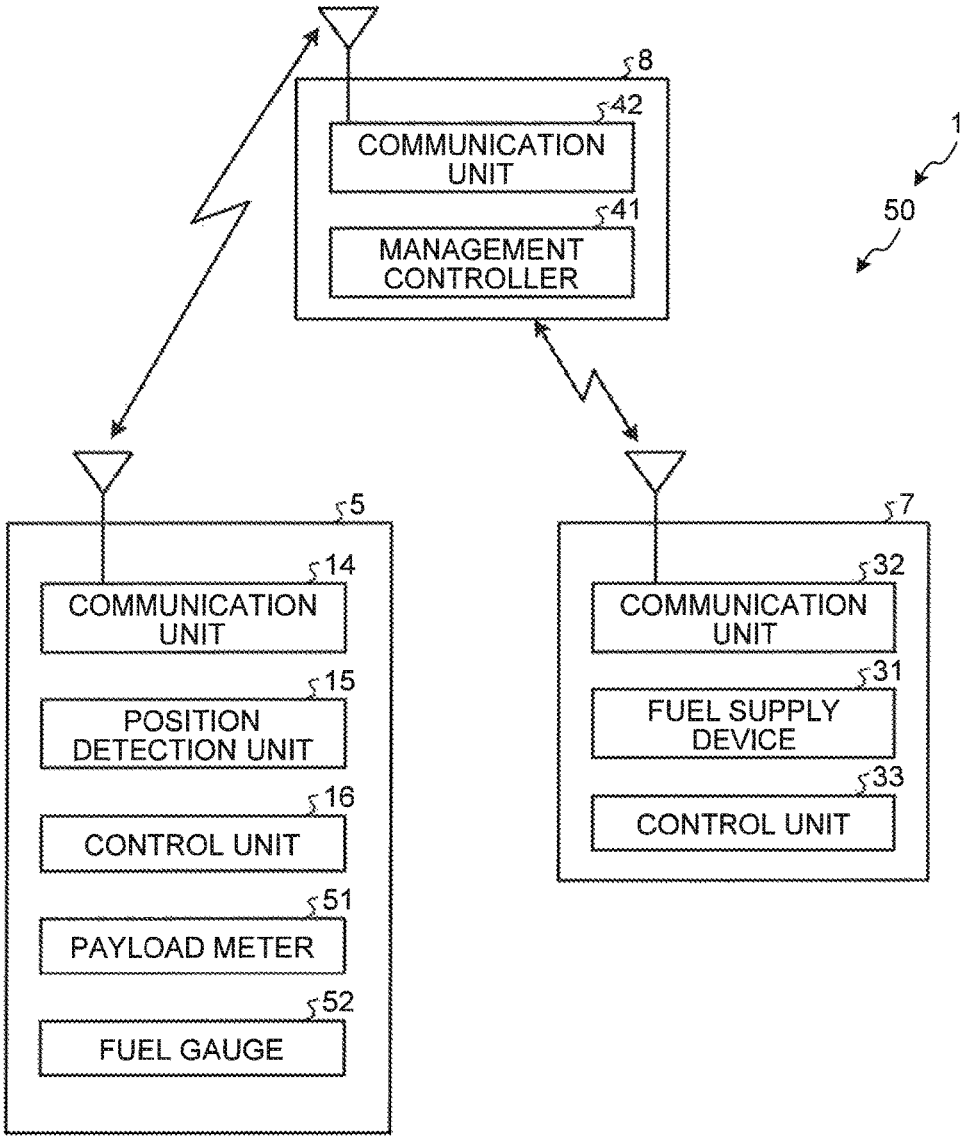
FIG. 2 is a block diagram illustrating a configuration of the automatic supply system.
Figure 3:
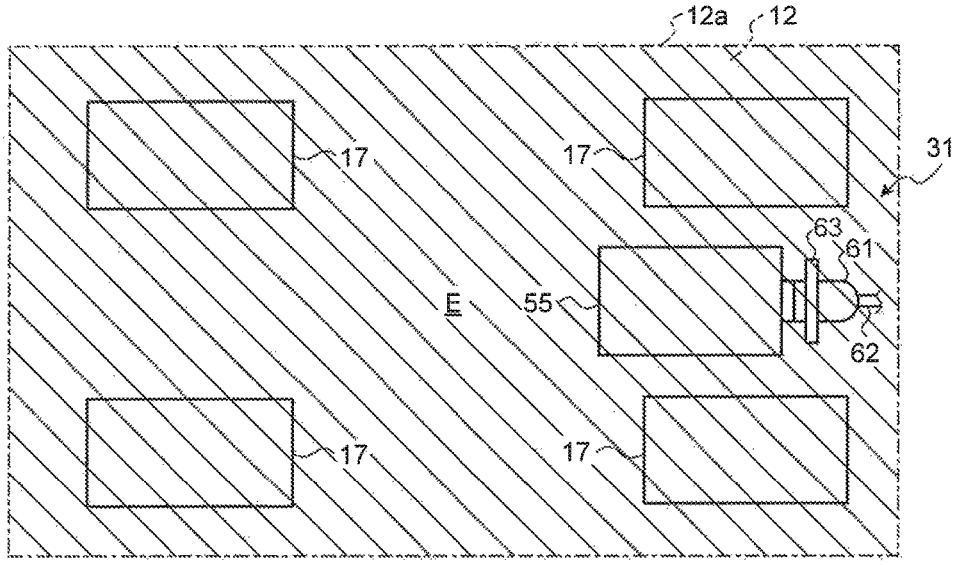
FIG. 3 is a plan view schematically illustrating a part of a transport vehicle.
Figure 4:
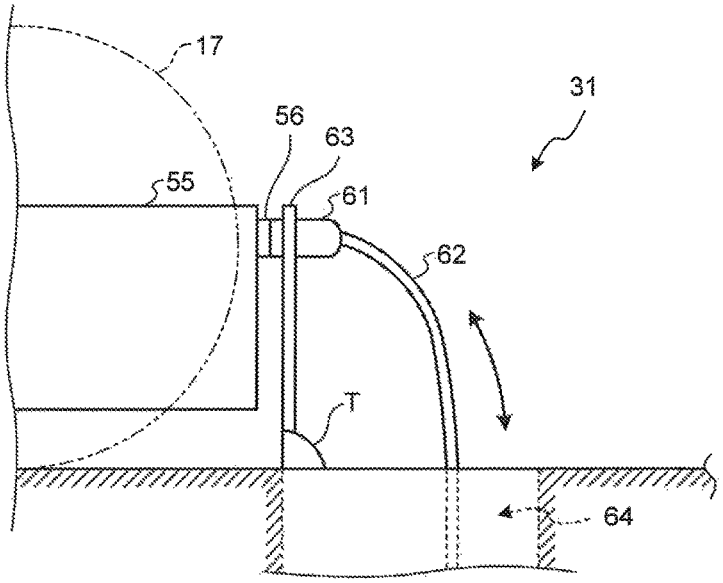
FIG. 4 is a side view schematically illustrating a part of a fuel supply device.

FIG. 2 is a block diagram illustrating a configuration of the automatic supply system, FIG. 3 is a plan view schematically illustrating a part of the transport vehicle, and FIG. 4 is a side view schematically illustrating a part of the fuel supply device. The trolley operation system 1 configured as described above is equipped with the automatic supply system 50 of a consumable material configured to supply a consumable material to the transport vehicle 5. In addition, as the consumable material, there are fuel, oil used for the lubrication and the hydraulic control, grease used for the lubrication and the like. In the first embodiment, a case where the fuel is applied as the consumable material will be described.

The automatic supply system 50 automatically supplies the fuel from the fuel supply device (automatic supply device) 31 of the refueling equipment 7 to the transport vehicle 5 capable of loading the cargo. As illustrated in FIG. 2, the automatic supply system 50 includes the transport vehicle (vehicle) 5, the refueling equipment 7, and the central management control equipment (controller) 8. Furthermore, the automatic supply system 50 has a payload meter (loadage detecting unit) 51 for detecting the loadage of the cargo loaded on the transport vehicle 5, and a fuel gauge 52 for detecting the residual fuel in the transport vehicle 5, and the payload meter 51 and the fuel gauge 52 are provided in the transport vehicle 5.

The payload meter 51 detects the loadage of the cargo loaded on the transport vehicle 5, based on the pressure of the pressure sensor for detecting the pressure of the suspension which supports the drive wheels 17 of the vehicle main body 11. The payload meter 51 is connected to the control unit 16 to output the detected loadage toward the control unit 16 as the loading information. The control unit 16 transmits the input loading information toward the central management control equipment 8 via the communication unit 14 and the communication unit 42.

The fuel gauge 52 measures the residual quantity of fuel remaining in a fuel tank 55 provided in the vehicle main body 11. The fuel gauge 52 is connected to the control unit 16 to output the detected residual quantity of fuel toward the control unit 16 as the supplying information. The control unit 16 transmits the input supplying information toward the central management control equipment 8 via the communication unit 14 and the communication unit 42.

In the central management control equipment 8, the supplying information and the loading information are input to the management controller 41 via the communication unit 42. When the input supplying information is obtained, the management controller 41 determines whether or not the fuel is supplied to the transport vehicle 5, based on the obtained supplying information. Furthermore, when the input loading information is obtained, the management controller 41 determines whether or not the cargo is loaded on the transport vehicle 5, based on the obtained loading information.

As will be described below in detail, when the management controller 41 determines that the transport vehicle 5 is supplied with the fuel, from the obtained supplying information, from the obtained loading information, in a case where the cargo is loaded on the transport vehicle 5, the management controller 41 does not cause the fuel supply device 31 to perform the automatic supply of fuel, and meanwhile, in a case where the cargo is not loaded on the transport vehicle 5, the management controller 41 causes the fuel supply device 31 to perform the automatic supply of fuel.

As illustrated in FIG. 3, when the transport vehicle 5 enters the refueling equipment 7, the fuel supply device 31 automatically refuels the fuel tank 55 provided in the vehicle main body 11 of the transport vehicle 5. The fuel tank 55 is provided on the rear side in the advancing direction of the transport vehicle 5, and the fuel tank 5 is provided with a refueling opening 56. The refueling opening 56 is provided on the outer side surface of the fuel tank 55, and is disposed in a range E that is an inner side than an edge portion 12*a* of the vessel 12 as viewed in a plan view from the vertical direction, on the lower side in the vertical direction of the vessel 12. In the first embodiment, although the fuel tank 55 is provided at one position on the rear side in the advancing direction, the fuel tank 55 may be provided on the front side in the advancing direction, and the arrangement position thereof is not limited.

As illustrated in FIGS. 3 and 4, the fuel supply device 31 has a supply nozzle 61 mounted to the refueling opening 56, a fuel hose 62 connected to the supply nozzle 61, a movable plate 63 for making the supply nozzle 61 movable, and a storage unit 64 for storing the supply nozzle 61 and the fuel hose 62. One end portion of the movable plate 63 is connected to a rotation axis T, and meanwhile, the other end portion thereof is a free end. For this reason, the movable plate 63 moves between a horizontal state and a vertical state around the rotation axis T. The storage unit 64 is formed on the ground under the refueling equipment 7, and stores the supply nozzle 61 and the fuel hose 62. In addition, the movable plate 63 serves as a lid of the storage unit 64, closes the storage unit 64 in the horizontal state, and opens the storage unit 64 in the vertical state.

The supply nozzle 61 is fixed to the free end side of the movable plate 63. For this reason, when the movable plate 63 enters the vertical state, the supply nozzle 61 is exposed from the storage unit 64, the refueling opening 56 and the supply nozzle 61 are connected to each other in the horizontal direction, and thus the supply nozzle 61 is mounted to the refueling opening 56 of the fuel tank 55. At the same time, the fuel, hose 62 connected to the supply nozzle 61 is drawn from the storage unit 64. On the other hand, when the movable plate 63 enters the horizontal state, the supply nozzle 61 is removed from the refueling opening 56 of the fuel tank 55, the supply nozzle 61 is stored in the storage unit 64, and the fuel hose 62 connected to the supply nozzle 61 is stored in the storage unit 64.

In addition, in the first embodiment, since the fuel tank 55 is provided on the rear side in the advancing direction of the transport vehicle 5, the fuel supply device 31 has a configuration provided at a position on the rear side of the transport vehicle 5 to supply the from the rear side of the transport vehicle 5, but the configuration of the fuel supply device 31 is not limited thereto. That is, in a case where the fuel tank 55 provided on the transport vehicle 5 is provided on the front side or the lateral side in the advancing direction, the fuel supply device 31 may have a configuration provided on the position on the front side or the lateral side of the transport vehicle 5 to supply the fuel from the front side or the lateral side of the transport vehicle 5.

Therefore, when the transport vehicle 5 enters the refueling equipment 7 and stops at a position capable of performing the fuel supply using the fuel supply device 31, the fuel supply device 31 performs the automatic supply with respect to the transport vehicle 5. That is, the fuel supply device 31 rotates the movable plate 63 around the rotation axis T from the horizontal state to the vertical state, thereby mounting the supply nozzle 61 to the refueling opening 56. When the supply nozzle 61 is mounted to the refueling opening 56, the fuel supply device 31 starts the supply of fuel. At this time, since the refueling opening 56 of the fuel tank 55 is within the range E, the fuel supply device 31 is able to supply the fuel within the range E. When the supply of fuel using the fuel supply device 31 is finished, the fuel supply device 31 rotates the movable plate 63 around the rotation axis T from the vertical state to the horizontal state, and removes the supply nozzle 61 from the refueling opening 56, thereby finishing the automatic supply of fuel. On the other hand, in a case were the automatic supply is not performed by the fuel supply device 31, since the fuel supply device 31 does not rotate the movable plate 63, the supply nozzle 61 is not mounted to the refueling opening 56. In addition, the invention is not limited to the above configuration, and in a case where the automatic supply is not performed by the fuel supply device 31, after the movable plate 63 is rotated around the rotation axis T from the horizontal state to the vertical state to mount the supply nozzle 61 to the refueling opening 56, the supply of fuel using the fuel supply device 31 may not be performed.

In addition, when the supply nozzle 61 is mounted to the refueling opening 56, the refueling equipment 7 may be provided with a camera to detect the position of the refueling opening 56 of the fuel tank 55 of the transport vehicle 5 by the camera, and the supply nozzle 61 may be mounted based on the detected position of the refueling opening 56 detected by the camera. In this case, the movable plate 63 may be configured so as to be movable so that the supply nozzle 61 is movable. That is, the control unit 33 of the refueling equipment 7 adjusts the position of the supply nozzle 61 with respect to the refueling opening 56, by controlling the position of the movable plate 63 based on the detected position of the refueling opening 56 detected by the camera. Thus, in the refueling equipment 7, it is possible to accurately mount the supply nozzle 61 to the refueling opening 56.

<Control Operation of Automatic Supply System>

Figure 5:
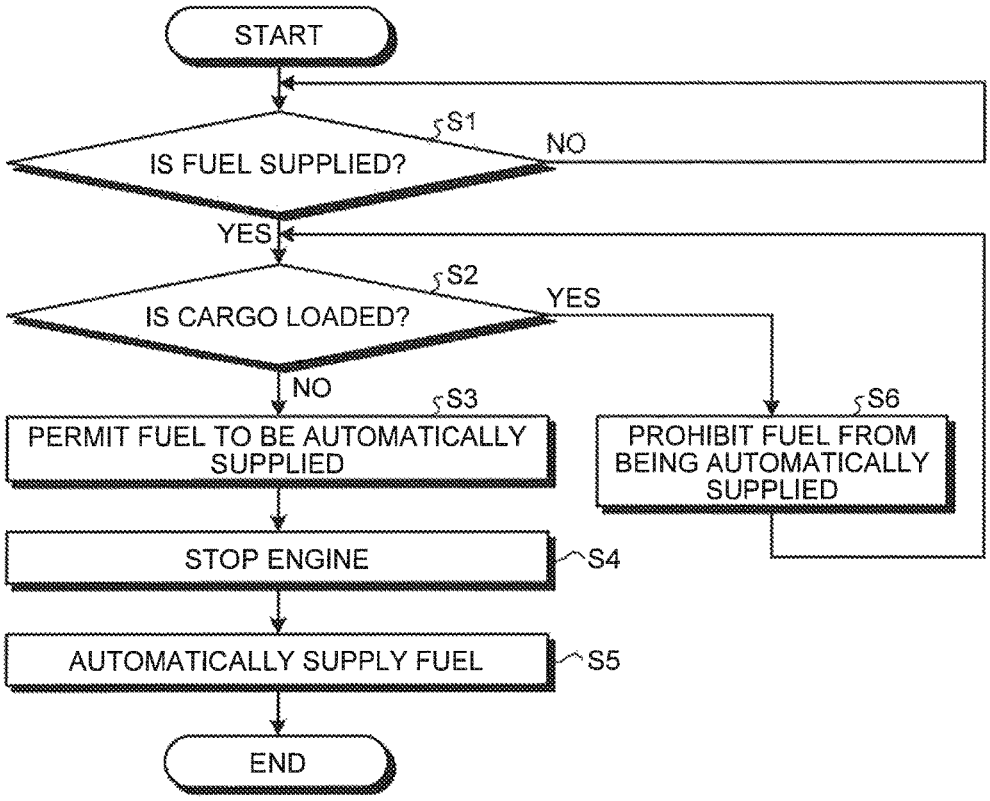
FIG. 5 is a flowchart illustrating control operation of the automatic supply system.

FIG. 5 is a flowchart relating to the control operation of the automatic supply system. The control operation of the automatic supply system 50 configured as above will be described with reference to FIG. 5. The supplying information detected by the fuel gauge 52 and the loading information detected by the payload meter 51 are transmitted toward the central management control equipment 8 from the transport vehicle 5, and the management controller 41 obtains the transmitted supplying information and loading information. Then, the management controller 41 determines whether or not the fuel is supplied to the transport vehicle 5 based on the obtained supplying information (step S1).

When the management controller 41 determines that the fuel is supplied to the transport vehicle 5 from the obtained supplying information (Yes in step S1), the management controller 41 determines whether or not the cargo is loaded on the transport vehicle 5 based on the obtained loading information (step S2). On the other hand, when the management controller 41 determines that the fuel is not supplied to the transport, vehicle 5 from the obtained supplying information (No in step S1), the process proceeds to step S1 again.

When the management controller 41 determines that the transport vehicle 5 is loaded with the cargo from the obtained loading information (Yes in step S2), the management controller 41 prohibits the automatic refueling using the fuel supply device 31 so as not to perform the automatic refueling to the transport vehicle 5 using the fuel supply device 31 (step S6). Moreover, after executing the step S6, the process proceeds to step S2, and the management controller 41 repeats the steps S2 and step S6 until the cargo of the transport vehicle 5 is unloaded.

In step S2, when the management controller 41 determines that the transport vehicle 5 is not loaded with the cargo from the obtained loading information (No in step S2), the management controller 41 permits the automatic refueling using the fuel supply device 31 so as to perform the automatic refueling to the transport vehicle 5 using the fuel supply device 31 (step S3). Thereafter, when the transport vehicle 5 enters the refueling equipment 7 and stops at a position capable of performing the fuel supply using the fuel supply device 31, the transport vehicle 5 stops the engine (step S4). Moreover, the fuel supply device 31 performs the automatic supply to the transport vehicle 5 (step S5). That is the fuel supply device 31 rotates the movable plate 63 of the fuel supply device 31 of the refueling equipment 7 around the rotation axis T, mounts the supply nozzle 61 to the refueling opening 56 of the fuel tank 55, and supplies the fuel. In addition, when the engine is stopped, the transport vehicle 5 transmits a stop signal of the engine to the refueling equipment 7, and the refueling equipment 7 preferably executes the automatic refueling, after receiving the stop signal transmitted from the transport vehicle 5.

As described above, according to the configuration of the first embodiment, in a case where the cargo is loaded on the transport vehicle 5, the management controller 41 does not perform the automatic refueling of the fuel using the fuel supply device 31. Thus, since the fuel can be automatically supplied in a state where the cargo is not loaded on the transport vehicle 5, the fall of the cargo during the fuel supply can be suppressed, and it is possible to reduce the damage of the refueling equipment 7 due to the fall of the cargo.

Furthermore, according to the configuration of the first embodiment, the management controller 41 is able to determine whether or not the cargo is loaded on the transport vehicle 5, based on the loading quantity of the cargo detected by the payload meter 51. For this reason, it is possible to utilize the existing payload meter 51 provided in the transport vehicle 5.

Furthermore, according to the configuration, of the first embodiment, the management controller 41 determines whether or not the fuel is supplied to the transport vehicle 5, based on the residual quantity of fuel detected by the fuel gauge 52 (step S1). For this reason, it is possible to utilize the existing fuel gauge 52 provided in the transport vehicle 5. Furthermore, the invention is not limited to this configuration, and in a case where the transport vehicle 5 is a dump truck that can perform the manned traveling, it may be determined whether or not the fuel is supplied to the transport vehicle 5 by the decision of a driver. That is, in the automatic supply system of a consumable material of the first embodiment, the configuration of the step S1 is not essential.

Furthermore, according to the configuration of the first embodiment, since the fuel supply device 31 is able to automatically supply the fuel within the range E, the fuel supply device 31 is not subject to the interference of the cargo falling from the vessel 12, and it is possible to reduce the damage to the fuel supply device 31 due to the fall of the cargo.

Second Embodiment

Next, an automatic supply system of a consumable material of a second embodiment will be described. Furthermore, in the second embodiment, in order to avoid the repeated description, only the different parts from the first embodiment will be described. In the first embodiment, although it is determined whether or not the automatic refueling is performed by the management controller 41, in the second embodiment, it is determined whether or not the automatic refueling is performed by a control unit (controller) 33 of the refueling equipment 7. That is, in the second embodiment, it is possible to perform the determination as to whether or not the automatic refueling is performed, even without using the management controller 41 of the central management control equipment 8. In other words, in the automatic supply system of a consumable material of the second embodiment, the configuration of the central management control equipment 8 is not essential.

The transport vehicle 5 transmits the loading information detected by the payload meter 51 toward the refueling equipment 7 via the communication unit 14 and the communication unit 32. In the refueling equipment 7, the loading information is input to the control unit 33 via the communication unit 32. When, the input loading information is obtained, the control unit 33 determines whether or not the cargo is loaded on the transport vehicle 5 based on the obtained loading information.

Herein, the control operation of the automatic supply system of the second embodiment will be briefly described. In addition, since the control operation of the automatic supply system of the second embodiment has a configuration substantially similar to the control operation of the automatic supply system 50 of the first embodiment, only different parts will be described with reference to FIG. 5.

The loading information detected by the payload meter 51 is transmitted towards the refueling equipment 7 from the transport vehicle 5, and the control unit 33 of the refueling equipment 7 obtains the transmitted loading information. Then, the control unit 33 of the refueling equipment 7 determines whether or not the cargo is loaded on the transport vehicle 5, based on the obtained loading information (step S2).

When the control unit 33 of the refueling equipment 7 determines that the transport vehicle 5 is loaded with the cargo from the obtained loading information (Yes in step S2), the control unit 33 of the refueling equipment 7 prohibits the automatic refueling using the fuel supply device 31 so as not to perform the automatic refueling to the transport vehicle 5 using the fuel supply device 31 (step S6). On the other hand, in step S2, when the control unit 33 of the refueling equipment 7 determines that the transport vehicle 5 is not loaded with the cargo from the obtained loading information (No in step S2), the control unit 33 of the refueling equipment 7 permits the automatic refueling using the fuel supply device 31 so as to perform the automatic refueling to the transport vehicle 5 using the fuel supply device 31 (step S3).

As described above, even in the configuration of the second embodiment, in a case where the cargo is loaded on the transport vehicle 5, the control unit 33 of the refueling equipment 7 does not perform the automatic refueling of the fuel using the fuel supply device 31. Thus, since the fuel can be automatically supplied in a state where the cargo is not loaded on the transport vehicle 5, the fall of the cargo during the fuel supply can be suppressed, and it is possible to reduce the damage of the refueling equipment 7 due to the fall of the cargo.

In addition, in the first and second embodiments, although the loading information was detected by the payload meter 51, instead of this configuration, the loading information may be detected by an imaging camera (imaging unit). In other words, an imaging camera is provided in the transport vehicle 5, and the imaging camera takes an image of the vessel 12 of the transport vehicle 5. The imaging camera is connected to the control unit 16 of the transport vehicle 5, and the control unit 16 transmits the loading information obtained from the imaging camera to the refueling equipment 7 or the central management control equipment 8. Moreover, when the transmitted loading information is obtained, the refueling equipment 7 or the central management control equipment 8 determines whether or not the cargo is loaded on the transport vehicle 5, based on the obtained loading information.

Third Embodiment

Next, an automatic supply system of a consumable material of a third embodiment will be described. In addition, even in the third embodiment, in order to avoid the repeated description, only different parts from the first embodiment will be described. In the first embodiment, the loading information was detected by the payload meter 51 provided in the transport vehicle 5, and it was determined whether or not the automatic refueling was performed by the management controller 41. However, in the third embodiment, the loading information is detected by a vehicle weight meter (vehicle weight measuring unit) provided in the refueling equipment 7, and it is determined whether or not the automatic refueling is performed by the control unit (controller) 33 of the refueling equipment 7. That is, in the third embodiment, even without performing the communication between the transport vehicle 5 and the central management control device 8, it is possible to perform the determination as to whether or not the automatic refueling is performed. In other words, in the automatic supply system of a consumable material of the third embodiment, the configuration of the communication unit 32 of the refueling equipment 7 is not essential.

The vehicle weight meter provided in the refueling equipment 7 is provided on the traveling route of the transport vehicle 5 to measure the weight of the transport vehicle 5 entering the refueling equipment 7. The vehicle weight meter is connected to the control unit 33 of the refueling equipment 7 to output the detected vehicle weight toward the control unit 33 from the vehicle weight meter, as the loading information. When the output loading information is obtained, the control unit 33 determines whether or not the cargo is loaded on the transport vehicle 5, based on the obtained loading information.

Here, the control operation of the automatic supply system of the third embodiment will be briefly described. In addition, since the control operation of the automatic supply system of the third embodiment also has a configuration substantially similar to the control operation of the automatic supply system 50 of the first embodiment, only different parts will be described with reference to FIG. 5.

When the transport vehicle 5 traveling toward the refueling equipment 7 rides on the vehicle weight meter, the vehicle weight meter outputs the loading information toward the control unit 33 of the refueling equipment 7, and the control unit 33 of the refueling equipment 7 obtains the output loading information. Then, the control unit 33 of the refueling equipment 7 determines whether or not the cargo is loaded on the transport vehicle 5, based on the obtained loading information (step S2).

When the control unit 33 of the refueling equipment 7 determines that the transport vehicle 5 is loaded with the cargo from the obtained loading information (Yes in step S2), the control unit 33 prohibits the automatic refueling using the fuel supply device 31 so as not to perform the automatic refueling to the transport vehicle 5 using the fuel supply device 31 (step S6). On the other hand, in step S2, when the control unit 33 of the refueling equipment 7 determines that the transport vehicle 5 is not loaded with the cargo from the obtained loading information (No in step S2), the control unit 33 permits the automatic refueling using the fuel supply device 31 so as to perform the automatic refueling to the transport vehicle 5 using the fuel supply device 31 (step S3).

As described above, even in the configuration of the third embodiment, in a case where the cargo is loaded on the transport vehicle 5, the control unit 33 of the refueling equipment 7 does not perform the automatic refueling of the fuel using the fuel supply device 31. Thus, since the fuel can be automatically supplied in a state where the cargo is not loaded on the transport vehicle 5, the automatic supply of fuel, the fall of the cargo during the fuel supply can be suppressed, and it is possible to reduce the damage of the refueling equipment 7 due to the fall of the cargo.

Furthermore, according to the configuration of the third embodiment, since it is possible to detect the loading information using the vehicle weight meter provided in the refueling equipment 7, there is no need to perform the communication between the transport vehicle 5 and the central management control device 8, and it is possible to perform the determination as to whether or not the automatic refueling is performed in the refueling equipment 7.

Furthermore, in the third embodiment, although the loading information was detected by the vehicle weight meter, instead of this configuration, the loading information may be detected by an imaging camera (imaging unit). In other words, the imaging camera is provided in the refueling equipment 7, and the imaging camera takes an image of the vessel 12 of the transport vehicle 5 entering the refueling equipment 7. The imaging camera is connected to the control unit 33 of the refueling equipment 7 to output the detected image toward the control unit 33 from the imaging camera, as the loading information. When the output loading information is obtained, the control unit 33 determines whether or not the cargo is loaded on the transport vehicle 5, based on the obtained loading information.

Furthermore, in the third embodiment, although the vehicle weight meter was connected to the control unit 33 of the refueling equipment 7, the vehicle weight meter may be provided as a separated body from the refueling equipment 7, and the vehicle weight meter may have a configuration capable of transmitting the detected loading information toward the transport vehicle 5, the refueling equipment 7 or the central management control equipment 8.

Further, in the first to third embodiments, although a case was described as being applied to the trolley transport system 1 using the transport vehicle 5 having the pantograph 13, the invention is not limited to this configuration, and the invention may also be applied to a transport system using the transport vehicle 5 not having the pantograph 13.

Furthermore, in the first, to third embodiments, although a dump truck capable of performing the unmanned driving was applied as the transport vehicle 5, the transport vehicle may be applied to a dump truck capable of performing the manned traveling. In the case of manned traveling, it is preferable to provide a notifying unit for notifying the fact that the cargo is loaded on the transport vehicle 5. As the notifying unit, for example, by providing a signal device in an inlet of the refueling equipment 7, the warning display may be performed on the signal device, and by providing a display monitor in a driver's cab of the transport vehicle 5, the warning display may be performed on the display monitor. According to this configuration, it is possible to suitably notify the fact that the cargo is loaded on the transport vehicle 5 with respect to a driver who drives the transport vehicle 5.

Further, in the first to third embodiments, although a case was described, as being applied to vehicles powered by the engine and the motor as the transport vehicle 5, the invention is not limited to this configuration, and the invention may also be applied to vehicles powered only by the engine and also may be applied to vehicles powered only by the motor that is driven using the engine.

Further, in the first to third embodiments, although it was determined whether or not the fuel is supplied to the transport vehicle 5 using the fuel gauge 52, the invention is not limited to this configuration, and instead of the fuel gauge 52, the determination as to whether or not the fuel is supplied to the transport vehicle 5 may be performed, by the use of the management controller 41 that manages the operating condition of the transport vehicle 5. Specifically, the management controller 41 manages the elapsed time until now after the transport vehicle 5 supplies the last fuel, as the operating conditions of the transport vehicle 5. Moreover, in a case where the elapsed time exceeds a preset setting time, the management controller 41 determines that the fuel is supplied to the transport vehicle 5, and meanwhile, in a case where the elapsed time does not exceed a preset setting time, the management controller 41 determines that the fuel is not supplied to the transport vehicle 5. Even in this configuration, the management controller 41 is able to determine whether or not the fuel is supplied to the transport vehicle 5.

Furthermore, in the first to third embodiments, although it was determined whether or not the automatic refueling is performed by the management controller 41 of the central management control equipment 8 or the control unit 33 of the refueling equipment 7, the invention is not limited to this configuration, and the determination may be performed by the control unit (controller) 16 provided in the transport vehicle 5. That is, when the control unit 16 of the transport vehicle 5 obtains the loading information, the control unit 16 may determine whether or not the automatic refueling is performed, and may transmit the determination result to the control unit 33 of the refueling equipment 7.

Furthermore, in the present embodiment, although the refueling opening 56 and the supply nozzle 61 were connected to each other in the horizontal direction, the supply nozzle 61 may be moved upward from the lower side in the vertical direction and may be connected to the refueling opening 56 located on the upper side in the vertical direction. According to this configuration, since the supply nozzle 61 may be moved in the vertical direction without being rotated, the mounting operation of the supply nozzle 61 can be performed within the range E, and it is possible to further reduce the interference of the cargo falling from the vessel 12.

REFERENCE SIGNS LIST

1 TROLLEY TRANSPORT SYSTEM
5 TRANSPORT VEHICLE
6 POWER FEEDING EQUIPMENT
7 REFUELING EQUIPMENT
8 CENTRAL MANAGEMENT CONTROL EQUIPMENT

11 VEHICLE MAIN BODY
12 VESSEL
13 PANTOGRAPH
14 COMMUNICATION UNIT
15 POSITION DETECTION UNIT
16 CONTROL UNIT
17 DRIVE WHEELS
18 LOADING YARD
19 EARTH-REMOVING YARD
21 TROLLEY WIRE
31 FUEL SUPPLY SYSTEM
32 COMMUNICATION UNIT
33 CONTROL UNIT
41 MANAGEMENT CONTROLLER
42 COMMUNICATION UNIT
50 AUTOMATIC SUPPLY SYSTEM
51 PAYLOAD METER
52 FUEL GAUGE
55 FUEL TANK
56 REFUELING OPENING
61 SUPPLY NOZZLE
62 FUEL HOSE
63 MOVABLE PLATE
64 STORAGE UNIT
T ROTATION AXIS
E RANGE

The invention claimed is:

1. An automatic supply system for supplying a consumable material comprising:

an automatic supply device that automatically supplies the consumable material to a dump truck having a vessel configured to be loaded with a cargo;

a cargo detection unit configured to detect whether or not the cargo is loaded on the vessel of the dump truck as loading information which is transmitted to a control device; and the control device that obtains the detected loading information, and is configured to control an automatic supply of the consumable material to the dump truck based on the obtained loading information, wherein when the control device determines that the cargo is not loaded on the vessel of the dump truck from the obtained loading information, the control device controls the automatic supply device to perform the automatic supply of the consumable material to the dump truck, and when the control device determines that the cargo is loaded on the vessel of the dump truck from the obtained loading information, the control device controls the automatic supply device not to perform the automatic supply of the consumable material to the dump truck.

2. The automatic supply system according to claim 1, wherein the cargo detection unit comprises a payload meter that detects loadage of the cargo loaded on the dump truck.

3. The automatic supply system according to claim 1, wherein the automatic supply device automatically supplies the consumable material to the dump truck via a refueling opening in the dump truck, the refueling opening being disposed below the vessel and in a position interior to an outer edge of the vessel.

4. An automatic supply system for supplying a consumable material comprising:

an automatic supply device that automatically supplies the consumable material to a dump truck having a vessel configured to be loaded with a cargo;

a cargo detection unit configured to detect whether or not the cargo is loaded on the vessel of the dump truck as loading information which is transmitted to a control device; and the control device configured to control the automatic supply device, wherein the automatic supply device automatically supplies the consumable material to the dump truck via a refueling opening in the dump truck, the refueling opening being disposed below the vessel of the dump truck and in a position interior to an outer edge of the vessel of the dump truck, and wherein when the control device determines that the cargo is not loaded on the vessel of the dump truck from the obtained loading information, the control device controls the automatic supply device to perform the automatic supply of the consumable material to the dump truck, and when the control device determines that the cargo is loaded on the vessel of the dump truck from the obtained loading information, the control device controls the automatic supply device not to perform the automatic supply of the consumable material to the dump truck.

* * * * *